US010007199B2

(12) United States Patent
Shimizu et al.

(10) Patent No.: US 10,007,199 B2
(45) Date of Patent: Jun. 26, 2018

(54) SINGLE-LAYER ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Junichiro Otsubo, Osaka (JP); Yasuhiro Oishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/248,540

(22) Filed: Aug. 26, 2016

(65) Prior Publication Data

US 2017/0068177 A1 Mar. 9, 2017

(30) Foreign Application Priority Data

Sep. 9, 2015 (JP) ..... 2015-177307

(51) Int. Cl.

| | |
|---|---|
| ***G03G 5/06*** | (2006.01) |
| ***G03G 5/10*** | (2006.01) |
| ***G03G 5/04*** | (2006.01) |
| ***G03G 15/00*** | (2006.01) |
| ***G03G 5/14*** | (2006.01) |

(52) U.S. Cl.

CPC ..... *G03G 5/0607* (2013.01); *G03G 5/04* (2013.01); *G03G 5/0609* (2013.01); *G03G 5/0631* (2013.01); *G03G 5/0696* (2013.01); *G03G 5/102* (2013.01); *G03G 5/144* (2013.01); *G03G 15/75* (2013.01); *G03G 2215/0129* (2013.01); *G03G 2215/0148* (2013.01)

(58) Field of Classification Search

CPC ..... G03G 5/102; G03G 5/144; G03G 5/0607; G03G 5/0609; G03G 5/0631; G03G 5/04; G03G 5/0696

USPC ..... 430/69, 65, 78, 72

See application file for complete search history.

(56) References Cited

U.S. PATENT DOCUMENTS

| | | | | |
|---|---|---|---|---|
| 5,162,185 | A * | 11/1992 | Fukuda | G03G 5/144 430/131 |
| 5,430,526 | A * | 7/1995 | Ohkubo | G03G 15/0233 399/159 |
| 5,783,344 | A * | 7/1998 | Kobayashi | G03G 5/144 430/65 |
| 6,991,885 | B2 * | 1/2006 | Ojima | G03G 9/0819 399/265 |
| 2008/0305418 | A1 * | 12/2008 | Hamasaki | G03G 5/0564 430/78 |
| 2014/0242507 | A1 * | 8/2014 | Shimizu | G03G 5/0609 430/56 |

FOREIGN PATENT DOCUMENTS

| | | | |
|---|---|---|---|
| JP | H04-278957 | A | 10/1992 |
| JP | 2000-226354 | * | 8/2000 |

OTHER PUBLICATIONS

Neufeldt, V. et al., Webster's New World Dictionary, Third College Edition, Simon & Schuster, Inc. NY (1988), p. 56.*

Japanese Patent Office JPlatPat machine-assisted English-language translation of JP 2000-226354 (pub. Aug. 2000).*

* cited by examiner

*Primary Examiner* — Janis L Dote

(74) *Attorney, Agent, or Firm* — Studebaker & Brackett PC

(57) ABSTRACT

A single-layer electrophotographic photosensitive member includes a conductive substrate and a photosensitive layer. The conductive substrate contains aluminum or an aluminum alloy. A surface of the conductive substrate has an aluminum oxide film or an aluminum alloy oxide film. The photosensitive layer is disposed directly on the conductive substrate. The photosensitive layer contains an electron transport material. The electron transport material has a reduction potential of at least −0.88 V and no greater than −0.66 V versus a reference electrode ($Ag/Ag^+$). The single-layer electrophotographic photosensitive member has a leakage onset voltage of at least 5.0 kV in a high temperature and humidity environment at a temperature of 30° C. and a relative humidity of 80%. The leakage onset voltage is a voltage applied to the single-layer electrophotographic photosensitive member at which current leakage starts.

8 Claims, 3 Drawing Sheets

SINGLE-LAYER ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2015-177307, filed on Sep. 9, 2015. The contents of this application are incorporated herein by reference in their entirety.

BACKGROUND

The present disclosure relates to a single-layer electrophotographic photosensitive member, a process cartridge, and an image forming apparatus.

An electrophotographic photosensitive member is used as an image bearing member in an electrophotographic image forming apparatus (for example, a printer or a multifunction peripheral). A generic electrophotographic photosensitive member includes a photosensitive layer. The photosensitive layer for example contains a charge generating material, a charge transport material (more specifically, a hole transport material or an electron transport material), and a resin (binder resin) for binding the aforementioned materials. The electrophotographic photosensitive member for example contains a charge generating material and a charge transport material in a single layer (photosensitive layer) and implements functions of charge generation and charge transport through the same layer. Such an electrophotographic photosensitive member is referred to as a single-layer electrophotographic photosensitive member. Alternatively, the photosensitive layer includes a charge generating layer containing a charge generating material and a charge transport layer containing a charge transport material. The electrophotographic photosensitive member including such a photosensitive layer is referred to as a multi-layer electrophotographic photosensitive member.

An electrophotographic photosensitive member described below is known. A multi-layer electrophotographic photosensitive member includes, as a photosensitive layer, a charge generating layer and a charge transport layer on a conductive substrate, and further includes a boehmite layer between the conductive substrate and the photosensitive layer.

SUMMARY

A single-layer electrophotographic photosensitive member according to an aspect of the present disclosure includes a conductive substrate and a photosensitive layer. The conductive substrate contains aluminum or an aluminum alloy. A surface of the conductive substrate has a film of an oxide of the aluminum or a film of an oxide of the aluminum alloy. The photosensitive layer is disposed directly on the conductive substrate. The photosensitive layer contains an electron transport material. The electron transport material has a reduction potential of at least −0.88 V and no greater than −0.66 V versus a reference electrode ($Ag/Ag^+$). The single-layer electrophotographic photosensitive member according to the aspect of the present disclosure has a leakage onset voltage of at least 5.0 kV in a high temperature and humidity environment at a temperature of 30° C. and a relative humidity of 80%. The leakage onset voltage is a voltage applied to the single-layer electrophotographic photosensitive member at which current leakage starts.

A process cartridge according to another aspect of the present disclosure includes the above-described single-layer electrophotographic photosensitive member.

An image forming apparatus according to still another aspect of the present disclosure includes an image bearing member and a charger. The image bearing member is the above-described single-layer electrophotographic photosensitive member. The charger charges a surface of the image bearing member. The charger has a positive charging polarity.

DETAILED DESCRIPTION

Figure 1A:
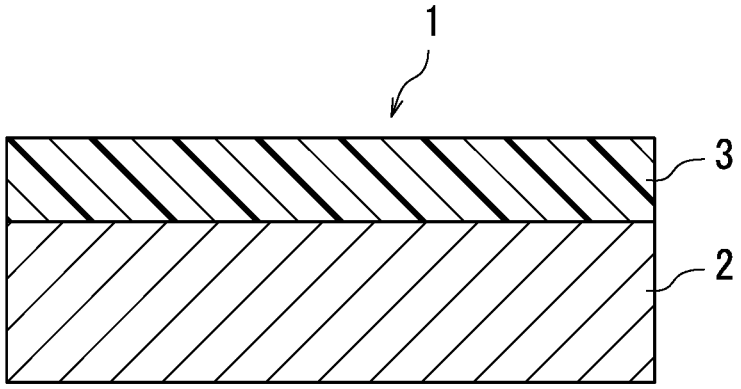
FIGS. 1A and 1B are schematic cross-sectional views each illustrating a structure of a single-layer electrophotographic photosensitive member according to a first embodiment of the present disclosure.

The following describes embodiments of the present disclosure in detail. However, the present disclosure is not in any sense limited by the following embodiments. The present disclosure can be implemented with appropriate alterations within the intended scope of the present disclosure. Note that although description is omitted as appropriate in some places in order to avoid repetition, such omission does not limit the essence of the present disclosure.

Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

First Embodiment: Single-Layer Electrophotographic Photosensitive Member

The first embodiment of the present disclosure relates to a single-layer electrophotographic photosensitive member (hereinafter, may be referred to simply as a photosensitive member). The photosensitive member according to the first embodiment has excellent sensitivity and can reduce occurrence of black spots in a high temperature and humidity environment. The reason for the above is thought to be as follows.

First, for convenience, occurrence of black spots will be described. An electrophotographic image forming apparatus for example includes an image bearing member (photosensitive member), a charging section, a light exposure section, a development section, and a transfer section. The light exposure section forms an electrostatic latent image on a surface of the photosensitive member. The development section develops the electrostatic latent image into a toner image. In a situation in which the electrostatic latent image is not maintained on the surface of the photosensitive member after the light exposure performed by the light exposure section, a non-exposed region of the photosensitive member may go through development with toner during the development performed by the development section. As a result, a plurality of dot images are formed on a non-image portion. Such an image defect may be referred to as black spots. Black spots are likely to occur particularly in a high temperature and humidity (for example, a temperature of 30° C. and a relative humidity of 80%) environment. The reason for the above is thought to be that moisture easily adheres to the surface of the photosensitive member in such a high temperature and humidity environment.

The photosensitive member according to the first embodiment has an oxide film as a surface of the conductive substrate. The photosensitive layer contains an electron transport material. A reduction potential of the electron transport material is at least −0.88 V and no greater than −0.66 V versus a reference electrode ($Ag/Ag^+$). A leakage onset voltage of the photosensitive member according to the first embodiment is at least 5.0 kV in a high temperature and humidity (for example, a temperature of 30° C. and a relative humidity of 80%) environment. The photosensitive member as described above tends to inhibit hole injection into the photosensitive layer. It is thought that an electrostatic latent image formed on the surface of the photosensitive member is therefore maintained in a stable manner. Thus, the photosensitive member according to the first embodiment can reduce occurrence of black spots even in a high temperature and humidity environment.

Furthermore, since the reduction potential of the electron transport material is at least −0.88 V and no greater than −0.66 V versus the reference electrode ($Ag/Ag^+$), the lowest unoccupied molecular orbital (LUMO) of the electron transport material is in the vicinity of the LUMO of the charge generating material. Accordingly, the electron transport material receives electrons from the charge generating material more readily. The photosensitive member according to the first embodiment therefore has excellent sensitivity.

The leakage onset voltage refers to a voltage applied to the photosensitive member at which current leakage starts. The leakage onset voltage is measured as a lowest value of the voltage applied to the photosensitive member at which dielectric breakdown occurs while the voltage is being increased. The leakage onset voltage can be measured using a pressure-resistant tester (testing instrument fabricated by KYOCERA Document Solutions Inc.). A method for measuring the leakage onset voltage will be described later in detail in Examples. Preferably, the leakage onset voltage in a high temperature and humidity environment is at least 5.0 kV and no greater than 9.0 kV.

Figure 1B:
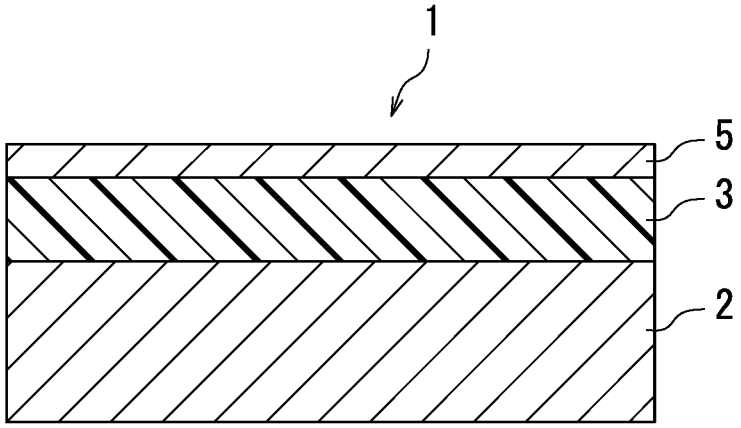

The following describes the photosensitive member with reference to FIGS. 1A and 1B. FIGS. 1A and 1B are schematic cross-sectional views each illustrating a structure of a photosensitive member 1. The photosensitive member 1 includes a conductive substrate 2 and a photosensitive layer 3. The photosensitive layer 3 is disposed directly on the conductive substrate 2. For example, the photosensitive layer 3 may be disposed directly on the conductive substrate 2 as illustrated in FIG. 1A. The photosensitive layer 3 may be exposed as an outermost layer as illustrated in FIG. 1A. A protective layer 5 may be disposed on the photosensitive layer 3 as illustrated in FIG. 1B. The following describes the conductive substrate and the photosensitive layer.

[1. Conductive Substrate]

The conductive substrate 2 contains aluminum or an aluminum alloy. As a result of the conductive substrate 2 containing aluminum or an aluminum alloy, charge transfer from the photosensitive layer 3 to the conductive substrate 2 tends to be improved. The aluminum alloy is an alloy of aluminum with elements other than aluminum. Examples of elements other than aluminum include manganese (Mn), silicon (Si), magnesium (Mg), copper (Cu), iron (Fe), chromium (Cr), titanium (Ti), and zinc (Zn). An aluminum alloy may contain one of the elements listed above as an element other than aluminum or may contain two or more of the elements listed above. Examples of aluminum alloys that can be used include Al—Mn alloys (1153000 series), Al—Mg alloys (JIS5000 series), and Al—Mg—Si alloys (JIS6000 series).

The conductive substrate 2 has an aluminum oxide film or an aluminum alloy oxide film as a surface thereof. The aluminum oxide film or the aluminum alloy oxide film is for example formed by performing an oxidation treatment on the surface of the conductive substrate 2.

Preferably, a proportion R of oxygen atoms present in the aluminum oxide film or the aluminum alloy oxide film is at least 20% and no greater than 50%. The proportion R of oxygen atoms can be determined in accordance with equation (1).

$$R=[A_O/(A_O+A_{Al})]\times 100 \qquad \text{Equation (1)}$$

In the equation (1), $A_O$ represents an oxygen atom concentration, which is determined by measuring the aluminum oxide film or the aluminum alloy oxide film by energy dispersive X-ray spectroscopy (EDX). $A_{Al}$ represents an aluminum atom concentration, which is determined by measuring the aluminum oxide film or the aluminum alloy oxide film by energy dispersive X-ray spectroscopy.

The oxygen atom concentration and the aluminum atom concentration can be measured using an energy dispersive X-ray spectrometer ("JSM-6380LV", product of JEOL Ltd.). A method for measuring the oxygen atom concentration and the aluminum atom concentration will be described later in detail in the Examples.

As a result of the proportion R of oxygen atoms being at least 20%, the oxide film of the conductive substrate 2 has a suitable electric resistance. Accordingly, charge injection (electron injection) from the conductive substrate 2 to the photosensitive layer 3 can be restricted. As a result of the proportion R of oxygen atoms being no greater than 50%, inhibition of hole transport from the photosensitive layer 3 to the conductive substrate 2 is difficult.

Preferably, the aluminum oxide film or the aluminum alloy oxide film has a thickness of at least 0.15 μm and no greater than 0.35 μm. As a result of having a thickness of at least 0.15 μm and no greater than 0.35 μm, the oxide film of the conductive substrate 2 has a suitable electric resistance. Consequently, charge injection (electron injection) from the conductive substrate 2 to the photosensitive layer can be restricted. Furthermore, hole transport from the photosensitive layer 3 to the conductive substrate 2 is less likely to be inhibited. The thickness of the oxide film can for example be measured using a reflective/transmissive thin film thickness measuring device ("NANOCALC-VIS", product of Tokyo Instruments, Inc.). A method for measuring the thickness of the oxide film will be described later in detail in the Examples.

The shape of the conductive substrate 2 may be selected as appropriate to match the structure of an image forming apparatus in which the conductive substrate 2 is to be used. The conductive substrate 2 may for example be sheet-shaped or drum-shaped. The thickness of the conductive substrate 2 can be selected as appropriate according to the shape of the conductive substrate 2.

[2. Photosensitive Layer]

As mentioned above, the photosensitive layer 3 contains an electron transport material. The photosensitive layer 3 may contain a charge generating material, a hole transport material, and various additives as necessary. The following describes the charge generating material, the electron transport material, the hole transport material, the binder resin, and additives.

(2-1. Charge Generating Material)

No particular limitations are placed on the charge generating material other than being a charge generating material that can be used in photosensitive members. Examples of charge generating materials that can be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (for example, selenium, selenium-tellurium, selenium-arsenic, cadmium sulfide, or amorphous silicon), pyrylium salts, anthanthrone-based pigments, triphenylmethane-based pigments, threne-based pigments, toluidine-based pigments, pyrazoline-based pigments, and quinacridone-based pigments.

Examples of phthalocyanine-based pigments that can be used include metal-free phthalocyanine represented by chemical formula (CGM-1) and metal phthalocyanine. Examples of metal phthalocyanine that can be used include titanyl phthalocyanine represented by chemical formula (CGM-2) and phthalocyanine having a metal other than titanium oxide as a coordination center (specific examples include V-form hydroxygallium phthalocyanine). The phthalocyanine-based pigment may be crystalline or non-crystalline. No particular limitations are placed on the crystal structure (for example, α-form, β-form, or Y-form) of the phthalocyanine-based pigments, and phthalocyanine-based pigments having various different crystal structures may be used.

(CGM-1)

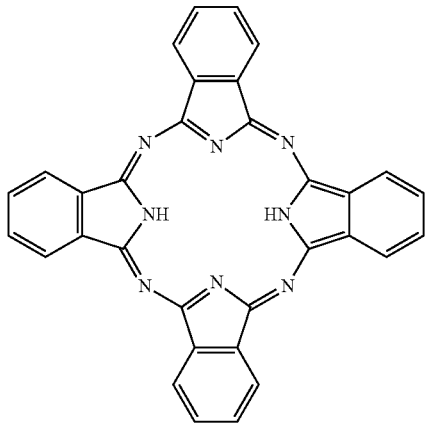

(CMG-2)

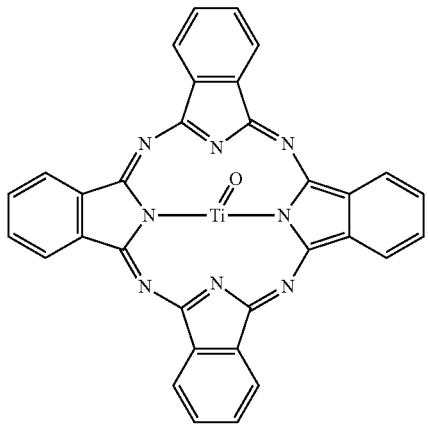

Examples of crystalline metal-free phthalocyanine that can be used include metal-free phthalocyanine having an X-form crystal structure (hereinafter, may be referred to as X-form metal-free phthalocyanine). Examples of crystalline titanyl phthalocyanine include titanyl phthalocyanine having an α-form, β-form, or Y-form crystal structure.

A single charge generating material having an absorption wavelength in a desired region or a combination of two or more charge generating materials may be used. Also, for example in a digital optical system image forming apparatus, the photosensitive member 1 that is sensitive to a range of wavelengths that are greater than or equal to 700 nm is preferably used. Accordingly, for example, a phthalocyanine-based pigment is preferable, and metal-free phthalocyanine or titanyl phthalocyanine is more preferable. One charge generating material may be used independently, or two or more charge generating materials may be used in combination. The digital optical system image forming apparatus may for example be a laser beam printer or facsimile machine in which a light source such as a semiconductor laser is used.

An anthanthrone-based pigment or a perylene-based pigment is favorably used as a charge generating material in the photosensitive member 1 that is applied to an image forming apparatus including a short-wavelength laser light source. The short-wavelength laser light for example has a wavelength of at least 350 nm and no greater than 550 nm.

The charge generating material is preferably contained in an amount of at least 0.1 parts by mass and no greater than 50 parts by mass relative to 100 parts by mass of the binder resin, and more preferably at least 0.5 parts by mass and no greater than 30 parts by mass.

(2-2. Electron Transport Material)

A reduction potential of the electron transport material is at least −0.88 V and no greater than −0.66 V versus a reference electrode ($Ag/Ag^+$). As a result of the reduction potential of the electron transport material being at least −0.88 V and no greater than −0.66 V, the photosensitive member has excellent sensitivity and can reduce occurrence of black spots in a high temperature and humidity environment. A method for measuring the reduction potential of the electron transport material will be described later in the Examples.

Preferably, the electron transport material is a compound represented by general formula (1), general formula (2), or general formula (3).

(1)

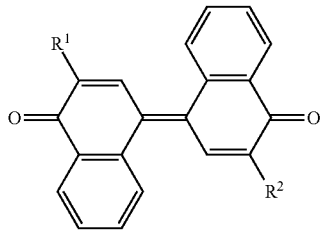

(2)

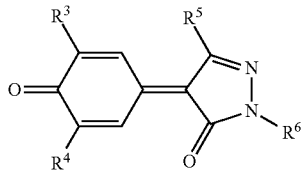

-continued (3)

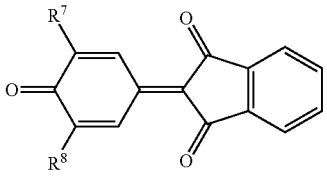

In the general formulae (1), (2), and (3), $R^1$, $R^2$, $R^3$, $R^4$, $R^5$, $R^6$, $R^7$, and $R^8$ each represent, independently of one another, an alkyl group that may have a substituent selected from the group consisting of alkoxy groups and halogen atoms or an aryl group that may have a substituent selected from the group consisting of alkoxy groups and halogen atoms.

The alkyl group represented by each of $R^1$ to $R^8$ in the general formulae (1) to (3) is preferably an alkyl group having a carbon number of at least 1 and no greater than 5. Examples of alkyl groups each having a carbon number of at least 1 and no greater than 5 include a methyl group, an ethyl group, an n-propyl group, an isopropyl group, an n-butyl group, a sec-butyl group, a tert-butyl group, an-pentyl group, and a tert-pentyl group. Of the alkyl groups listed above, an isopropyl group, a tert-butyl group, or a tert-pentyl group is more preferable.

The alkyl group represented by each of $R^1$ to $R^8$ in the general formulae (1) to (3) may have an alkoxy group or a halogen atom as a substituent. Preferably, the alkoxy group is for example an alkoxy group having a carbon number of at least 1 and no greater than 5. Examples of alkoxy groups each having a carbon number of at least 1 and no greater than 5 include a methoxy group, an ethoxy group, an n-propoxy group, an isopropoxy group, an n-butoxy group, a sec-butoxy group, a tert-butoxy group, an n-pentoxy group, and a tert-pentoxy group. Examples of halogen atoms include a fluorine atom, a chlorine atom, a bromine atom, and an iodine atom.

The aryl group represented by each of $R^1$ to $R^8$ in the general formulae (1) to (3) is preferably an aryl group having a carbon number of at least 6 and no greater than 10, and more preferably a phenyl group or a naphthyl group. The aryl group represented by each of $R^1$ to $R^8$ in the general formulae (1) to (3) may have an alkoxy group or a halogen atom as a substituent. The substituent of the aryl group represented by each of $R^1$ to $R^8$ in the general formulae (1) to (3) is a substituent selected from the group consisting of alkoxy groups and halogen atoms. The alkoxy group that may be a substituent of the aryl group is as defined for the alkoxy groups that may be a substituent of the alkyl group represented by each of $R^1$ to $R^8$ in the general formulae (1) to (3). The halogen atom that may be a substituent of the aryl group is as defined for the halogen atom that may be a substituent of the alkyl group represented by each of $R^1$ to $R^8$ in the general formulae (1) to (3). The halogen atom is preferably a chlorine atom.

Preferably, $R^1$ to $R^4$ and $R^6$ to $R^8$ in the general formulae (1), (2), and (3) each represent, independently of one another, an alkyl group having a carbon number of at least 1 and no greater than 5. In the general formula (2), $R^6$ preferably represents a phenyl group having a halogen atom, and more preferably a dichlorophenyl group.

Specific examples of electron transport materials that can be used include compounds represented by chemical formulae (ETM-1) to (ETM-3) (hereinafter, may be referred to as compounds (ETM-1) to (ETM-3)).

(ETM-1)

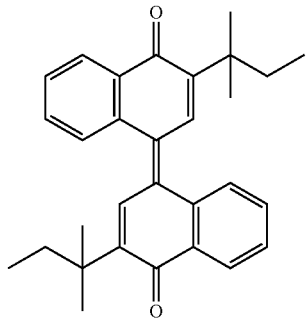

(ETM-2)

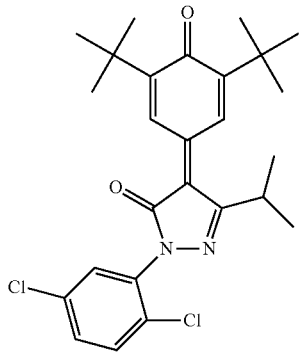

(ETM-3)

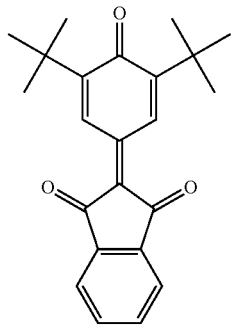

The electron transport material may contain an optional electron transport material in addition to the electron transport material having a reduction potential such as described above. No particular limitations are placed on the optional electron transport material other than being applicable to the photosensitive member 1. Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination.

The electron transport material is preferably contained in an amount of at least 5 parts by mass and no greater than 100 parts by mass relative to 100 parts by mass of the binder resin, and more preferably at least 10 parts by mass and no greater than 80 parts by mass.

(2-3. Hole Transport Material)

No particular limitations are placed on the hole transport material other than being applicable to the photosensitive member 1. A nitrogen containing cyclic compound or a condensed polycyclic compound may for example used as the hole transport material. Examples of nitrogen-containing cyclic compounds and condensed polycyclic compounds that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific example include 9-(4-diethylaminostyryl)anthracene), carbazole-based compounds (specific examples include polyvinyl carbazole), organic polysilane compounds, pyrazoline-based compound (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. Any one of the hole transport materials listed above may be used independently, or any two or more of the hole transport materials listed above may be used in combination.

Specific examples of hole transport materials that can be used include compounds represented by chemical formulae (HTM-1) to (HTM-6) (hereinafter, may be referred to as compounds (HTM-1) to (HTM-6)).

(HTM-1)

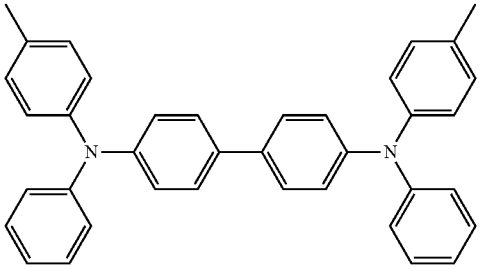

(HTM-2)

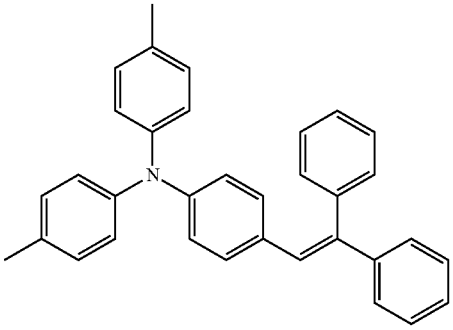

(HTM-3)

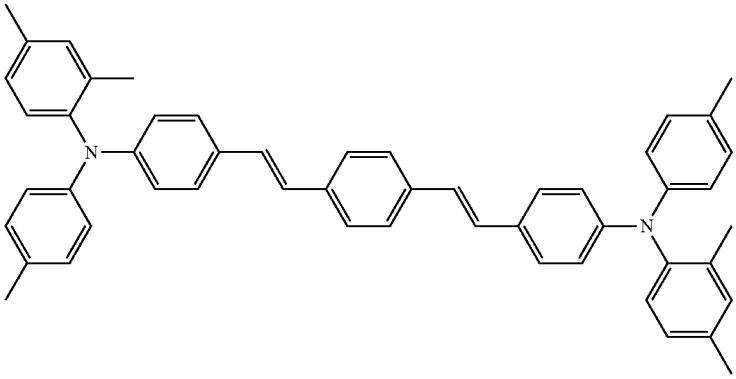

(HTM-4)

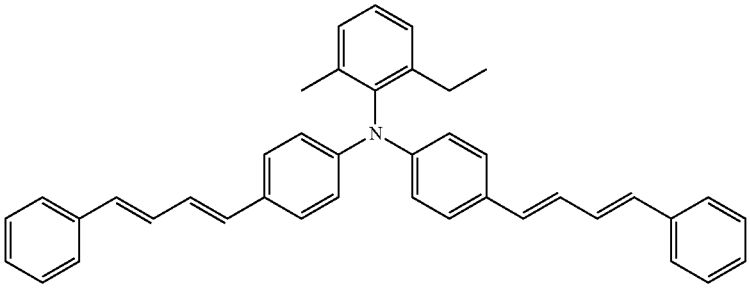

-continued (HTM-5)

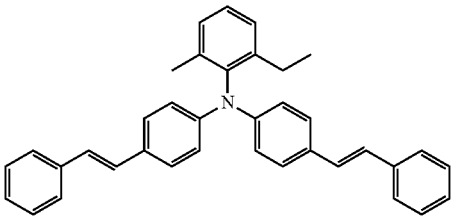

(HTM-6)

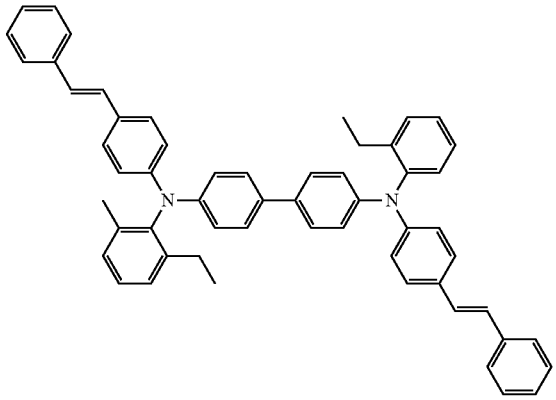

The hole transport material is preferably contained in an amount of at least 10 parts by mass and no greater than 200 parts by mass relative to 100 parts by mass of the binder resin, and more preferably at least 10 parts by mass and no greater than 100 parts by mass.

(2-4. Binder Resin)

The photosensitive layer 3 can contain a binder resin. Examples of binder resins that can be used include thermoplastic resins, thermosetting resins, and photocurable resins. Examples of thermoplastic resins that can be used include polyester resins, polycarbonate resins, styrene-based resins, styrene-butadiene resins, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, and polyether resins. Examples of thermosetting resins that can be used include silicone resins, epoxy resins, phenolic resins, urea resins, melamine resins, and other crosslinkable thermosetting resins. Examples of photocurable resins that can be used include epoxy acrylate resins and urethane-acrylate copolymers. Any one of the resins listed above may be used independently, or any two or more of the resins listed above may be used in combination.

Of the binder resins listed above, a polycarbonate resin is preferable. As a result of the binder resin being a polycarbonate resin, the photosensitive layer 3 having excellent balance in terms of processability, mechanical properties, optical properties, and abrasion resistance is readily obtained. In terms of readily improving toner image transferability of the photosensitive member 1, the polycarbonate resin is preferably a bisphenol Z polycarbonate resin, a bisphenol CZ polycarbonate resin, or a bisphenol C polycarbonate resin, and more preferably a resin represented by chemical formula (Z), chemical formula (C), or chemical formula (CZ) shown below. The number attached to each repeating unit in the chemical formulae (Z), (C), and (CZ) indicates the molar ratio of the repeating unit relative to the total number of moles of repeating units included in the corresponding resin.

(Z)

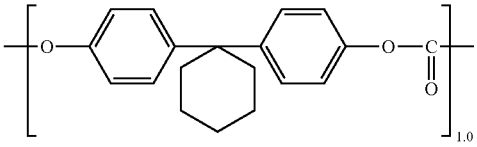

(C)

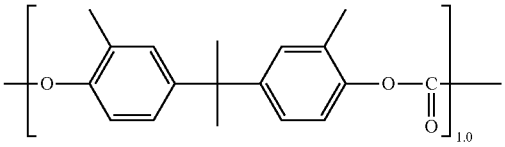

(CZ)

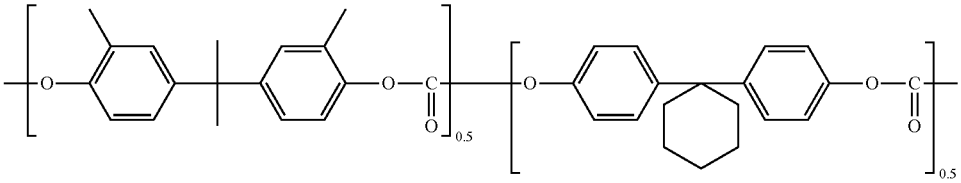

The binder resin preferably has a viscosity average molecular weight of at least 40,000, and more preferably at least 40,000 and no greater than 52,500. As a result of the binder resin having a viscosity average molecular weight of at least 40,000, abrasion resistance of the photosensitive member 1 can be readily improved. As a result of the binder resin having a viscosity average molecular weight of no greater than 52,500, the binder resin has a high tendency to dissolve in a solvent and viscosity of an application liquid for formation of the photosensitive layer 3 has a low tendency to be too high when the photosensitive layer 3 is formed. Consequently, the photosensitive layer 3 can be readily formed.

(2-5. Additives)

Examples of additives that can be used include antidegradants (specific examples include antioxidants, radical scavengers, singlet quenchers, and ultraviolet absorbing agents), softeners, surface modifiers, extending agents, thickeners, dispersion stabilizers, waxes, acceptors, donors, surfactants, plasticizers, sensitizers, and leveling agents. Examples of antioxidants include hindered phenols, hindered amines, paraphenylenediamine, arylalkanes, hydroquinone, spirochromanes, spiroindanones, derivatives of any of the above compounds, organosulfur compounds, and organophosphorus compounds.

Through the above, the photosensitive member 1 according to the first embodiment has been described with reference to FIGS. 1A and 1B. The photosensitive member 1 according to the first embodiment has excellent sensitivity and can reduce occurrence of black spots in a high temperature and humidity environment.

Second Embodiment: Photosensitive Member Production Method

The following describes a production method of the photosensitive member 1 with reference to FIGS. 1A and 1B. The production method of the photosensitive member 1 includes an oxide film formation step and a photosensitive layer formation step. The following describes the oxide film formation step and the photosensitive layer formation step.

[1. Oxide Film Formation Step]

In the oxide film formation step, a conductive substrate is immersed in water, taken out of water, and heated to form an aluminum oxide film or an aluminum alloy oxide film on a surface of the conductive substrate. The water has a volume resistivity of at least $1.0\times10^6$ Ω·cm. The water has a temperature of at least 70° C. and less than 80° C. The conductive substrate is immersed in water for at least 60 seconds and no greater than 90 seconds. The conductive substrate may be heated at ambient atmosphere. The heating temperature is at least 110° C. and no greater than 150° C., and more preferably at least 120° C. and no greater than 140° C. The heating time may be at least 5 minutes and no greater than 30 minutes.

The oxide film formation step may further include an ionized alkaline water immersion step. In the ionized alkaline water immersion step, the conductive substrate 2 is immersed in ionized alkaline water prior to formation of the oxide film. Through the above, at least a portion of an oxide film already formed on the surface of the conductive substrate 2 can be removed. As a result, a new oxide film can be formed on the conductive substrate 2, and the conductive substrate 2 having a desired electric resistance can be readily formed.

Preferably, the ionized alkaline water has a pH of at least 9 and no greater than 12. Preferably, the conductive substrate 2 is immersed in the ionized alkaline water for at least 20 seconds and no greater than 120 seconds.

Subsequently, the conductive substrate is taken out of the ionized alkaline water and water adhering thereto is removed. The water may be removed by heating. The heating may be performed at a heating temperature of at least 110° C. and no greater than 150° C. at ambient atmosphere. The heating time may be at least 5 minutes and no greater than 30 minutes. The conductive substrate 2 may for example be heated using an oven.

[2. Photosensitive Layer Formation Step]

In the photosensitive layer formation step, an application liquid for photosensitive layer formation (hereinafter, may be referred to simply as an application liquid) is applied onto the conductive substrate 2, and at least a portion of a solvent contained in the applied application liquid is removed to form the photosensitive layer 3. The application liquid contains at least an electron transport material and a solvent. The photosensitive layer formation step for example includes an application liquid preparation step, an application step, and a drying step. The following describes the application liquid preparation step, the application step, and the drying step.

(2-1. Application Liquid Preparation Step)

In the application liquid preparation step, the application liquid is prepared. The application liquid may contain a charge generating material, a hole transport material, a binder resin, or an additive as necessary. The application liquid can for example be prepared by dissolving or dispersing the electron transport material represented by the general formula (1), (2), or (3) and an optional component (specific examples include a charge generating material, a hole transport material, a binder resin, and an additive) in the solvent.

No particular limitations are placed on the solvent contained in the application liquid other than that the components of the application liquid is soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, N,N-dimethylformamide (DMF), and dimethyl sulfoxide. One of the solvents listed above may be used independently, or two or more of the solvents listed above may be used in combination. Of the solvents listed above, a non-halogenated solvent is preferable.

The application liquid is prepared by mixing the components in order to cause dissolution or dispersion in the solvent. Mixing, dissolving, or dispersing can for example be performed using a bead mill, a roll mill, a ball mill, an attritor, a paint shaker, or an ultrasonic disperser.

The application liquid may for example contain a surfactant or a leveling agent in order to improve dispersibility of the components or improve surface flatness of the photosensitive layer 3 to be formed.

(2-2. Application Step)

In the application step, the application liquid is applied onto the conductive substrate 2. No particular limitations are placed on the method by which the application liquid is applied so long as the method for example enables uniform application of the application liquid onto the conductive substrate 2. Examples of the application method include dip coating, spray coating, spin coating, and bar coating.

Preferably, the application liquid is applied by dip coating in terms of readily adjusting the thickness of the photosensitive layer 3 to a desired value. In the application step that is performed by dip coating, the conductive substrate 2 is immersed in the application liquid. Subsequently, the conductive substrate 2 is drawn out of the application liquid. Through the above, the application liquid is applied onto the conductive substrate 2.

(2-3. Drying Step)

In the drying step, at least a portion of the solvent contained in the application liquid applied to the conductive substrate 2 is removed. No specific limitations are placed on the method by which the solvent in the application liquid is removed other than being a method that enables removal (specific examples include evaporation) of at least a portion of the solvent in the application liquid. Examples of methods that can be used to remove the solvent include heating, pressure reduction, and a combination of heating and pressure reduction. Specific examples thereof include heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

The production method of the photosensitive member 1 may further include a step of forming the protective layer 5 as necessary. A known method is selected as appropriate for the step of forming the protective layer 5.

Through the above, the production method of the photosensitive member 1 according to the second embodiment has been described with reference to FIGS. 1A and 1B. The production method of the photosensitive member 1 according to the second embodiment can produce a photosensitive member that has excellent sensitivity and that can reduce occurrence of black spots in a high temperature and humidity environment.

Third Embodiment: Image Forming Apparatus

The third embodiment of the present disclosure relates to an image forming apparatus. The image forming apparatus includes the photosensitive member 1 as an image bearing member. The photosensitive member 1 has excellent sensitivity and can reduce occurrence of black spots in a high temperature and humidity environment as mentioned for the first embodiment. The image forming apparatus including such a photosensitive member 1 is therefore thought to be capable of forming images while reducing occurrence of black spots in a high temperature and humidity environment with the photosensitive member 1 having excellent sensitivity.

Figure 2:
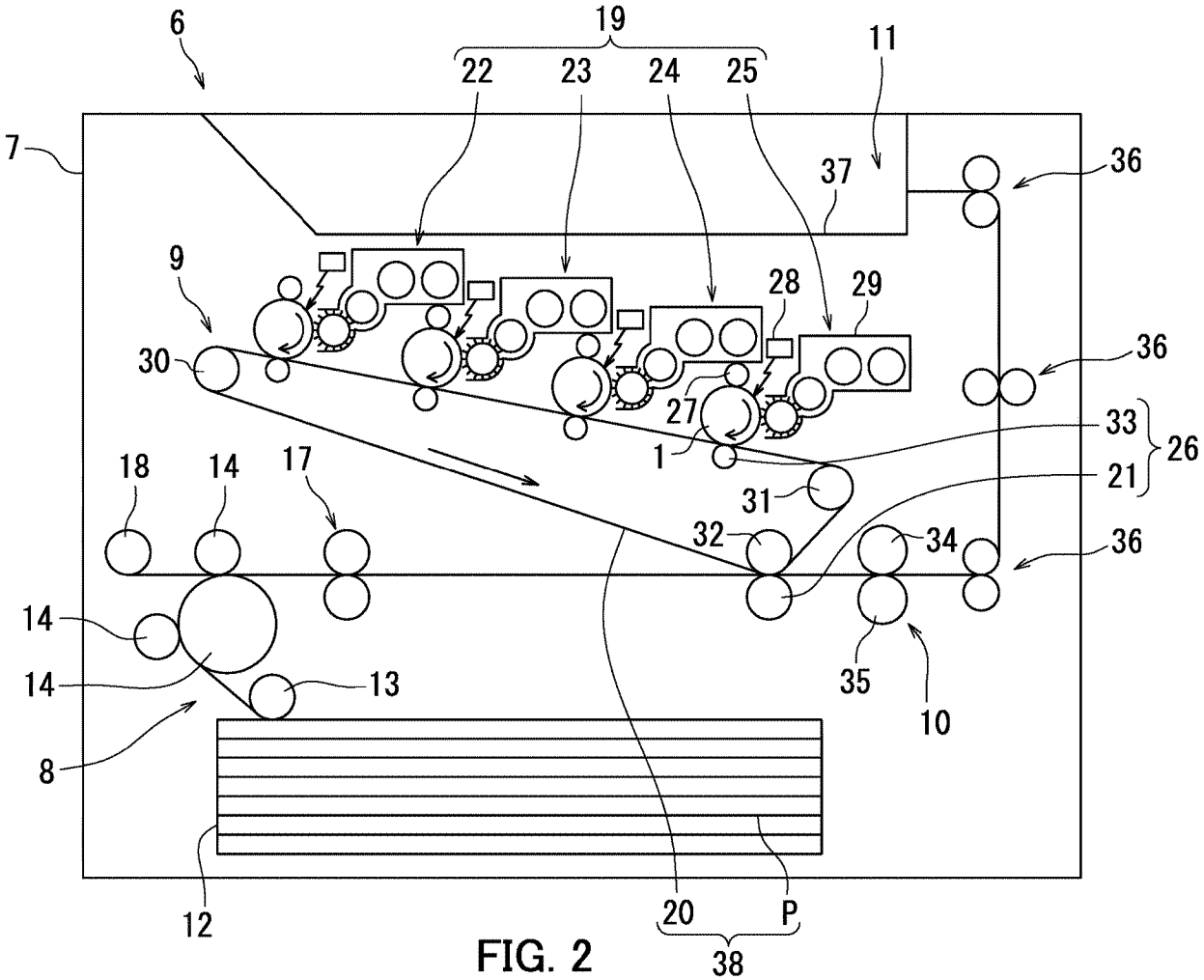
FIG. 2 is a schematic view illustrating a configuration of one form of an image forming apparatus according to a third embodiment of the present disclosure.
Figure 3:
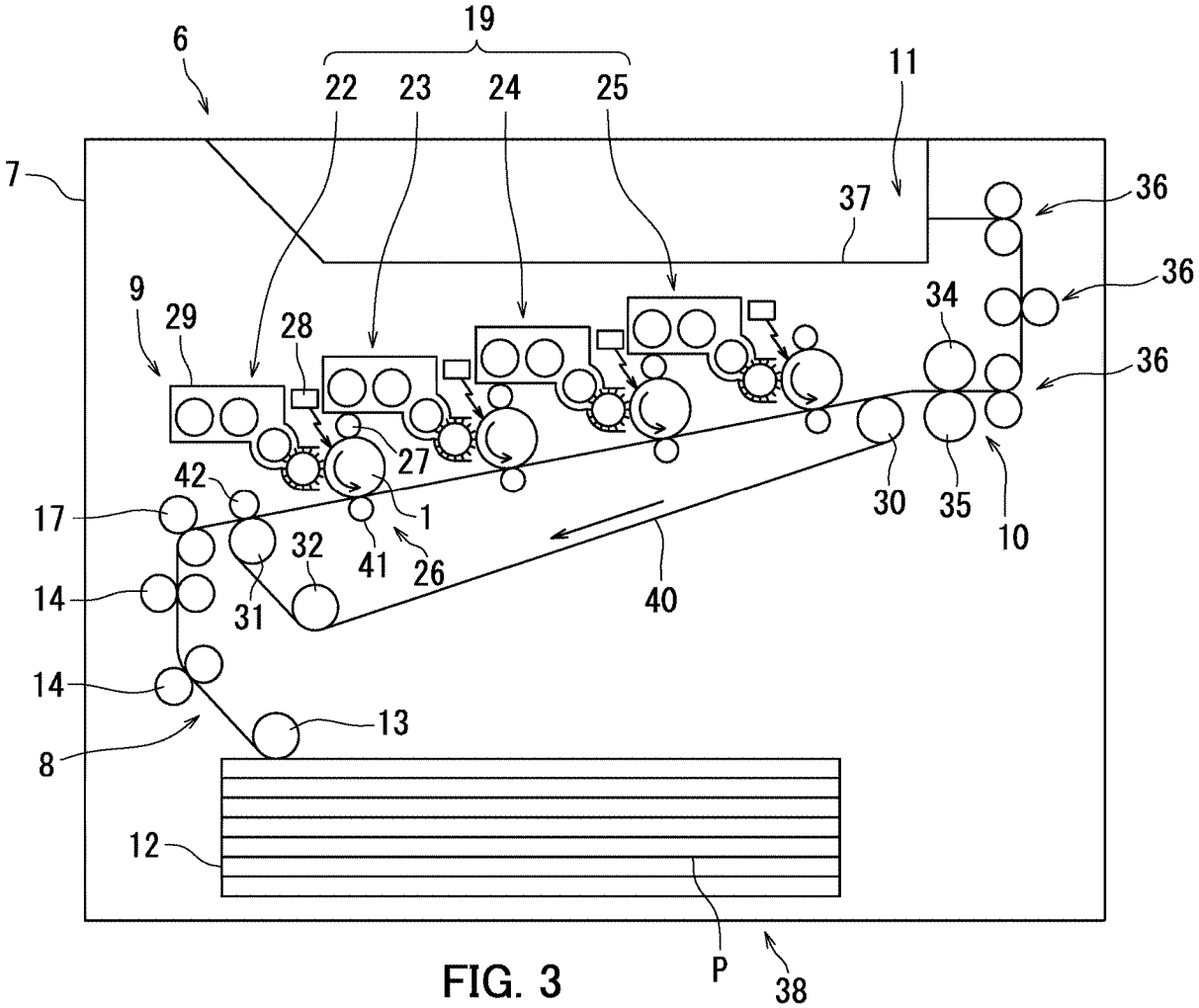
FIG. 3 is a schematic view illustrating a configuration of an alternative form of the image forming apparatus according to the third embodiment.

The following describes the image forming apparatus according to the third embodiment with reference to FIGS. 2 and 3. First, description is given of an example in which the image forming apparatus adopts an intermediate transfer process with reference to FIG. 2. FIG. 2 is a schematic view illustrating a configuration of one form of the image forming apparatus according to the third embodiment. An image forming apparatus 6 includes the photosensitive member 1 according to the first embodiment as an image bearing member.

The image forming apparatus 6 according to the third embodiment includes the image bearing member 1 and a charging section 27, which is equivalent to a charger. The charging section 27 charges the surface of the image bearing member 1. The charging section 27 has a positive charging polarity. The image forming apparatus 6 according to the third embodiment further includes a light exposure section 28, which is equivalent to a light exposure device, a development section 29, and a transfer section 26. The light exposure section 28 exposes the charged surface of the image bearing member 1 to light to form an electrostatic latent image on the surface of the image bearing member 1. The development section 29 develops the electrostatic latent image into a toner image. The transfer section 26 transfers the toner image from the image bearing member 1 to a transfer target 38. In a configuration in which the image forming apparatus 6 adopts the intermediate transfer process, as illustrated in FIG. 2, the transfer section 26 is equivalent to primary transfer rollers 33. The transfer target 38 is equivalent to an intermediate transfer member (for example, an intermediate transfer belt 20).

No particular limitations are placed on the image forming apparatus 6 other than being an electrophotographic image forming apparatus. The image forming apparatus 6 may for example be a monochrome image forming apparatus or a color image forming apparatus. In order to form toner images of different colors using toners of different colors, the image forming apparatus 6 may be a tandem color image forming apparatus.

The following describes the image forming apparatus 6 taking a tandem color image forming apparatus as an example. The image forming apparatus 6 includes a plurality of the image bearing members 1 arranged side-by-side in a specific direction and a plurality of the development sections 29. The development sections 29 are disposed opposite to the image bearing members 1 in one-to-one correspondence. The development sections 29 each include a development roller. Each development roller conveys and supplies a toner to the surface of a corresponding one of the image bearing members 1 by bearing the toner thereon.

As illustrated in FIG. 2, the image forming apparatus 6 further includes a boxlike apparatus housing 7. A paper feed section 8, an image forming section 9, and a fixing section 10 are disposed inside the apparatus housing 7. The paper feed section 8 feeds paper P. The image forming section 9 transfers toner images based on image data to the paper P while conveying the paper P fed by the paper feed section 8. After an unfixed toner image is transferred onto the paper P by the image forming section 9, the fixing section 10 fixes the unfixed toner image to the paper P. Furthermore, a paper ejection section 11 is provided in a top surface of the apparatus housing 7. After the unfixed toner image is fixed to the paper P by the fixing section 10, the paper ejection section 11 ejects the paper P.

The paper feed section 8 includes a paper feed cassette 12, a first pickup roller 13, a plurality of paper feed rollers 14, and a pair of registration rollers 17. The paper feed cassette 12 is attachable to and detachable from the apparatus housing 7. Various sizes of paper P can be loaded into the paper feed cassette 12. The first pickup roller 13 is located above a left side of the paper feed cassette 12. The first pickup roller 13 picks up paper P stored in the paper feed cassette 12 one sheet at a time. The paper feed rollers 14 convey the paper P picked up by the first pickup roller 13. The pair of registration rollers 17 temporarily halts the paper P conveyed by the paper feed rollers 14 and subsequently supplies the paper P to the image forming section 9 at a specific timing.

The paper feed section 8 may further include a manual feed tray (not illustrated) and a second pickup roller 18. The manual feed tray is attached to a left side surface of the apparatus housing 7. The second pickup roller 18 picks up paper P loaded on the manual feed tray. The paper P picked up by the second pickup roller 18 is conveyed by the paper feed rollers 14 and is supplied to the image forming section 9 at a specific timing by the pair of registration rollers 17.

The image forming section 9 includes an image forming unit 19, the intermediate transfer belt 20, and a secondary transfer roller 21. The image forming unit 19 performs primary transfer of a toner image onto a circumferential surface of the intermediate transfer belt 20 (contact surface with the image bearing members 1). The toner image that undergoes primary transfer is formed based on image data transmitted from a higher-level device, such as a computer. The secondary transfer roller 21 performs secondary transfer of the toner image on the intermediate transfer belt 20 to the paper P fed from the paper feed cassette 12.

The image forming unit 19 includes a yellow toner supply unit 25, a magenta toner supply unit 24, a cyan toner supply unit 23, and a black toner supply unit 22. In the image forming unit 19, the yellow toner supply unit 25, the magenta toner supply unit 24, the cyan toner supply unit 23, and the black toner supply unit 22 are arranged in order from upstream (right side in FIG. 2) to downstream in a circulation direction of the intermediate transfer belt 20 relative to the yellow toner supply unit 25 as a reference point. The image bearing member 1 is located at a central position in each of the units 22, 23, 24, and 25. The image bearing members 1 are provided such as to be rotatable in an arrow direction (clockwise). Note that each of the units 22, 23, 24, and 25 may be a process cartridge described below that is attachable to and detachable from a main body of the image forming apparatus 6.

Each charging section 27, each light exposure section 28, and each development section 29 are located around a corresponding one of the image bearing members 1 in order from upstream in a rotation direction of the image bearing member 1 relative to the charging section 27 as a reference point.

A static eliminator (not illustrated) and a cleaning device (not illustrated) may be provided upstream of the charging section 27 in the rotation direction of the image bearing member 1. The static eliminator eliminates static from a circumferential surface (surface) of the image bearing member 1 after primary transfer of the toner image onto the intermediate transfer belt 20 has been performed. After the surface of the image bearing member 1 has been subjected to cleaning and static elimination by the cleaning device and the static eliminator, the surface is subjected to a new charging process as the circumferential surface passes the charging section 27. In a configuration in which the image forming apparatus 6 includes cleaning devices and static eliminators, each charging section 27, each light exposure section 28, each development section 29, each cleaning device, and each static eliminator are provided around a corresponding one of the image bearing members 1 in order from upstream in the rotation direction of the image bearing member 1. The development section 29 may function as a cleaning device. The development section 29 will be described later in detail.

As already mentioned above, the charging section 27 charges the surface of the image bearing member 1. More specifically, the charging section 27 uniformly charges the surface of the image bearing member 1. No specific limitations are placed on the charging section 27 other than enabling uniform charging of the circumferential surface of the image bearing member 1. The charging section 27 may be a non-contact charging section or a contact charging section. The non-contact charging section 27 applies voltage to the image bearing member 1 without being in contact with the image bearing member 1. When the charging section 27 is a non-contact charging section, the charging section 27 is for example a corona discharge charging section and, more specifically, is for example a corotron charging device or a scorotron charging device. The contact charging section applies voltage to the image bearing member 1 while in contact with the image bearing member 1. When the charging section 27 is a contact charging section, the charging section 27 is for example a charging roller or a charging brush. Discharge of active gases (for example, ozone and nitrogen oxides) generated by the charging section 27 can be inhibited by using a contact charging section as the charging section 27. As a result, deterioration of the photosensitive layer 3 due to active gases can be inhibited while also achieving a design that takes into consideration use in an office environment.

The charging section 27 can charge the surface of the image bearing member 1 while in contact with the image bearing member 1 as described above. That is, the image forming apparatus 6 according to the third embodiment can adopt a so-called contact charging process. In the image forming apparatus 6 that adopts the contact charging process, typically, each charging section 27 and the corresponding image bearing member 1 are in contact with one another during development, and therefore a toner-component matter, or a non-toner-component matter is likely to remain on and adhere to the surface of the image bearing member 1. It is thought that the matter adhering to the surface of the image bearing member 1 absorbs moisture and prevents an electrostatic latent image formed on the surface of the image bearing member 1 from being maintained in a stable manner. As described above, the image forming apparatus 6 according to the third embodiment restricts hole injection to the photosensitive layers and therefore can reduce occurrence of black spots in a high temperature and humidity environment. The image forming apparatus 6 according to the third embodiment can therefore form images while reducing occurrence of black spots in a high temperature and humidity environment even through the contact charging process. Hereinafter, a toner-component matter or a non-toner-component matter remaining on the surface of the image bearing member 1 may be referred to as a residual matter. The toner-component matter is for example a toner or an external additive detached from the toner. The non-toner-component matter is for example paper dust.

The charging roller is for example a charging roller that passively rotates in accordance with rotation of the image bearing member 1 while in contact with the surface of the image bearing member 1. Furthermore, the charging roller is for example a charging roller for which at least a surface part thereof is made from a resin. In a more specific example, the charging roller is a charging roller that includes a metal core that is rotatably supported, a resin layer formed on the metal core, and a voltage applying section that applies voltage to the metal core. In a configuration in which the charging section 27 includes a charging roller such as described above, the charging section 27 can charge the surface of the image bearing member 1, which is in contact therewith via the resin layer, through the voltage applying section applying voltage to the metal core.

No specific limitations are placed on the resin used to make the resin layer of the charging roller other than enabling favorable charging of the surface of the image bearing member 1. Specific examples of the resin used to make the resin layer include silicone resins, urethane resins, and silicone modified resins. The resin layer may contain an inorganic filler.

No specific limitations are placed on the voltage applied by the charging section 27. The voltage applied by the charging section 27 is for example an alternating current voltage, a composite voltage of an alternating current voltage superimposed on a direct current voltage, or a direct current voltage. Preferably, the charging section 27 only applies a direct current voltage. The charging section 27 that only applies a direct current voltage is advantageous as described below compared to the charging section 27 that applies an alternating current voltage or to the charging section 27 that applies a superimposed voltage. In a configuration in which the charging section 27 only applies a direct current voltage, the value of voltage applied to the image bearing member 1 is constant, and therefore it is easy to uniformly charge the surface of the image bearing member 1 to a specified potential. Furthermore, in a configuration in which the charging section 27 only applies a direct current voltage, the amount of abrasion of the photosensitive layer 3 tends to be smaller. It is thought that as a result, suitable images can be formed. The direct current voltage applied to the image bearing member 1 by the charging section 27 is preferably at least 1,000 V and no greater than 2,000 V, more preferably at least 1,200 V and no greater than 1,800 V, and particularly preferably at least 1,400 V and no greater than 1,600 V.

The light exposure section 28 is for example a laser scanning unit. The light exposure section 28 exposes the charged surface of the image bearing member 1 to light to form an electrostatic latent image on the surface of the image bearing member 1. More specifically, the light exposure section 28 emits laser light based on image data input from a higher-level device, such as a computer, onto the surface of the image bearing member 1, which is uniformly charged by the charging section 27. Through the above, an electrostatic latent image based on the image data is formed on the surface of the image bearing member 1.

As already described above, the development section 29 develops the electrostatic latent image into a toner image. More specifically, the development section 29 supplies toner onto the surface of the image bearing member 1 on which the electrostatic latent image has been formed to form a toner image based on the image data. The toner image that is formed subsequently undergoes primary transfer onto the intermediate transfer belt 20. The toner has a positive charging polarity.

The development section 29 can develop the electrostatic latent image into a toner image while in contact with the image bearing member 1. That is, the image forming apparatus 6 according to the third embodiment can adopt a so-called contact development process. In the image forming apparatus 6 that adopts the contact development process, typically, the development roller and the image bearing member 1 are in contact with one another during development, and therefore a toner-component matter or a non-toner-component matter is likely to remain on and adhere to the surface of the image bearing member 1. It is thought that the matter adhering to the surface of the image bearing member 1 absorbs moisture and prevents the electrostatic latent image formed on the surface of the image bearing member 1 from being maintained in a stable manner. The image forming apparatus 6 according to the third embodiment tends to restrict hole injection to the photosensitive layer of the photosensitive member 1. It is thought that the electrostatic latent image formed on the surface of the photosensitive member is therefore maintained in a stable manner. The image forming apparatus 6 according to the third embodiment can therefore form images while reducing occurrence of black spots in a high temperature and humidity environment even through the contact development process.

The development section 29 can clean the surface of the image bearing member 1. That is, the development section 29 can remove a residual matter from the surface of the image bearing member 1. The residual matter can prevent the electrostatic latent image from being maintained in a stable manner. As a result of the development section 29 cleaning the surface of the image bearing member 1 to remove the residual matter, therefore, the image forming apparatus 6 according to the third embodiment can form images while further reducing occurrence of black spots in a high temperature and humidity environment.

In order that the development section 29 efficiently cleans the surface of the image bearing member 1, the following conditions (1) and (2) are preferably satisfied.

Condition (1): A contact development process is employed, and rotation speed of the image bearing member and a rotation speed of the development roller are different.

Condition (2): A difference between a surface potential of the image bearing member 1 and a potential of the development bias satisfies relation (2-1) and relation (2-2) shown below.

0 (*V*)<Potential (*V*) of development bias<Surface potential (*V*) of non-exposed region of image bearing member — Relation (2-1)

Potential (*V*) of development bias>Surface potential (*V*) of exposed region of image bearing member>0 (*V*) — Relation (2-2)

In the relation (2-1), the surface potential of a non-exposed region of the image bearing member 1 refers to a surface potential of a region of the image bearing member 1 that has not been exposed to light by the light exposure section 28. In the relation (2-2), the surface potential of an exposed region of the image bearing member 1 refers to a surface potential of a region of the image bearing member 1 that has been exposed to light by the light exposure section 28. Note that the surface potential of the non-exposed region of the image bearing member 1 and the surface potential of the exposed region of the image bearing member 1 are measured after toner image transfer from the image bearing member 1 to the transfer target by the transfer section 26 and before charging of the surface of the image bearing member 1 by the charging section 27 for the next rotation.

When the condition (1) is satisfied, that is, in a configuration in which the contact development process is adopted, and the rotation speed of the image bearing member 1 and the rotation speed of the development roller are different, the surface of the image bearing member 1 is in contact with the development roller, and a residual matter on the surface of the image bearing member 1 is removed by rubbing against the development roller.

Preferably, the rotation speed of the image bearing member 1 is at least 120 mm/second and no greater than 350 mm/second. Preferably, the rotation speed of the development roller is at least 133 mm/second and no greater than 700 mm/second. Preferably, a ratio between the rotation speed $V_P$ of the image bearing member 1 and the rotation speed $V_D$ of the development roller satisfies relation (1-1) shown below. The ratio being not equal to 1 means that the rotation speed of the image bearing member 1 and the rotation speed of the development roller are different.

$$0.5 \leq V_P/V_D \leq 0.8 \quad \text{Relation (1-1)}$$

The following describes the condition (2) taking, as an example, a configuration in which the toner has a positive charging polarity, and a reversal development process is adopted. When the condition (2) is satisfied, that is, in a configuration in which the potential of the development bias is different from the surface potential of the image bearing member 1, the surface potential (charge potential) of the image bearing member 1 and the potential of the development bias satisfy the relation (2-1) with respect to the non-exposed region. Accordingly, an electrostatic repulsion between remaining toner (hereinafter, may be referred to as residual toner) and the non-exposed region of the image bearing member 1 is greater than an electrostatic repulsion between the residual toner and the development roller. As a result, the residual toner moves from the surface of the image bearing member 1 to the development roller to be collected. The toner tends not to adhere to the non-exposed region of the image bearing member 1.

When the condition (2) is satisfied, that is, in a configuration in which the potential of the development bias is different from the surface potential of the image bearing member 1, the surface potential (sensitivity potential) of the image bearing member 1 and the potential of the development bias satisfy the relation (2-2) with respect to the exposed region. Accordingly, an electrostatic repulsion between the residual toner and the exposed region of the image bearing member 1 is smaller than an electrostatic repulsion between the residual toner and the development roller. As a result, the residual toner on the surface of the image bearing member 1 is maintained on the surface of the image bearing member 1. The toner adheres to the exposed region of the image bearing member 1.

The potential of the development bias is for example at least +250 V and no greater than +400 V. The charge potential of the image bearing member 1 is for example at least +450 V and no greater than +900 V. The sensitivity potential of the image bearing member 1 is for example at least +50 V and no greater than +200 V. The difference between the potential of the development bias and the charge potential of the image bearing member 1 is for example at least +150 V and no greater than +300 V. The difference between the potential of the development bias and the sensitivity potential of the image bearing member 1 is for example at least +100 V and no greater than +700 V. A potential difference herein refers to an absolute value of the difference. Such a potential difference can for example be established under conditions of a potential of the development bias of +330 V, a charge potential of the image bearing member 1 of +600 V, and a sensitivity potential of the image bearing member 1 of +100 V.

The intermediate transfer belt 20 is an endless circulating belt. The intermediate transfer belt 20 is wrapped against a drive roller 30, a driven roller 31, a backup roller 32, and the plurality of primary transfer rollers 33. The intermediate transfer belt 20 is located such that the surface of each of the image bearing members 1 is in contact with the circumferential surface of the intermediate transfer belt 20.

Furthermore, the intermediate transfer belt 20 is pressed against the image bearing members 1 by the primary transfer rollers 33. The endless intermediate transfer belt 20 is driven by the drive roller 30 to circulate while in a pressed state in an arrow direction (i.e., clockwise). The drive roller 30 is rotationally driven by a drive source, such as a stepping motor, and imparts driving force that causes circulation of the endless intermediate transfer belt 20. The driven roller 31, the backup roller 32, and the primary transfer rollers 33 and passively rotate in accompaniment to circulation of the endless intermediate transfer belt 20 by the drive roller 30. The driven roller 31, the backup roller 32, and the primary transfer rollers 33 support the intermediate transfer belt 20.

The primary transfer rollers 33 are disposed opposite to the image bearing members 1 in one-to-one correspondence. Each of the primary transfer rollers 33 transfers a toner image onto the intermediate transfer belt 20 from a corresponding one of the image bearing members 1. More specifically, the primary transfer rollers 33 each apply a primary transfer bias (more specifically, a bias of opposite polarity to toner charging polarity) to the intermediate transfer belt 20. As a result, toner images formed on the respective photosensitive members 1 are transferred (primary transfer) in order onto the circulating intermediate transfer belt 20. Each of the toner images is transferred onto the intermediate transfer belt 20 between the corresponding photosensitive member 1 and primary transfer roller 33.

The secondary transfer roller 21 applies a secondary transfer bias (more specifically, a bias of opposite polarity to the toner images) to paper P. As a result, the toner images that have undergone primary transfer onto the intermediate transfer belt 20 are transferred onto the paper P between the secondary transfer roller 21 and the backup roller 32. Through the above, an unfixed toner image is transferred onto the paper P.

The fixing section 10 fixes the unfixed toner image that has been transferred onto the paper P by the image forming section 9. The fixing section 10 includes a heating roller 34 and a pressure roller 35. The heating roller 34 is heated by a conductive heating element. The pressure roller 35 is located opposite to the heating roller 34 and has a circumferential surface that is pressed against a circumferential surface of the heating roller 34.

A transfer image that has been transferred onto paper P by the secondary transfer roller 21 in the image forming section 9 is fixed to the paper P through a fixing process in which the paper P is heated as the paper P passes between the heating roller 34 and the pressure roller 35. The paper P is ejected to the paper ejection section 11 after being subjected to the fixing process. A plurality of conveyance rollers 36 are provided at appropriate positions between the fixing section 10 and the paper ejection section 11.

The paper ejection section 11 is formed by a recess at the top of the apparatus housing 7. An exit tray 37 that receives ejected paper P is provided on a bottom surface of the recess. Through the above, the image forming apparatus 6 according to the third embodiment has been described with reference to FIG. 2.

The following describes an image forming apparatus according to an alternative form of the third embodiment with reference to FIG. 3. FIG. 3 is a schematic view illustrating a configuration of the alternative form of the image forming apparatus according to the third embodiment. The image forming apparatus 6 illustrated in FIG. 3 is different from the image forming apparatus 6 illustrated in FIG. 2 in that the image forming apparatus 6 illustrated in FIG. 3 does not have the intermediate transfer belt 20 (intermediate transfer member). The transfer section in the image forming apparatus 6 illustrated in FIG. 3 is equivalent to transfer rollers 41. The transfer target in the image forming apparatus 6 illustrated in FIG. 3 is equivalent to a recording medium (paper P). That is, the image forming apparatus illustrated in FIG. 3 adopts a direct transfer process. Note that elements in FIG. 3 that correspond to elements in FIG. 2 are labelled using the same reference signs and redundant description is omitted.

As illustrated in FIG. 3, a transfer belt 40 is an endless circulating belt. The transfer belt 40 is wrapped against the drive roller 30, the driven roller 31, the backup roller 32, and the plurality of transfer rollers 41. The transfer belt 40 is located such that the surface of each of the image bearing members 1 is in contact with a surface (contact surface) of the transfer belt 40. The transfer rollers 41 are disposed opposite to the image bearing members 1 in one-to-one correspondence. The transfer belt 40 is pressed against the image bearing members 1 by the transfer rollers 41. The endless transfer belt 40 is driven by the plurality of rollers 30, 31, 32, and 41 to circulate while in a pressed state. The drive roller 30 is rotationally driven by a drive source, such as a stepping motor, and imparts driving force that causes circulation of the endless transfer belt 40. The driven roller 31, the backup roller 32, and the transfer rollers 41 are freely rotatable. The driven roller 31, the backup roller 32, and the transfer rollers 41 passively rotate in accompaniment to circulation of the endless transfer belt 40 by the drive roller 30. These rollers 31, 32, and 41 support the transfer belt 40 while also passively rotating. The paper P fed from the pair of registration rollers 17 is placed on the transfer belt 40 by a placement roller 42. The paper P placed on the transfer belt 40 passes between the image bearing members 1 and the transfer rollers 41 as the transfer belt 40 circulates.

The transfer section transfers toner images from the respective image bearing members 1 to the paper P as each of the image bearing members 1 comes in contact with the paper P. More specifically, each of the transfer rollers 41 applies a transfer bias (more specifically, a bias of opposite polarity to toner charging polarity) to the paper P placed on the transfer belt 40. As a result, a toner image formed on each of the photosensitive members 1 is transferred onto the paper P as the paper P passes between the photosensitive member 1 and the corresponding transfer roller 41. The transfer belt 40 is driven by the drive roller 30 to circulate in an arrow direction (i.e., clockwise). As the transfer belt 40 circulates, the paper P placed on the transfer belt 40 passes between the image bearing members 1 and the corresponding transfer rollers 41 in order. As the paper P passes between the image bearing members 1 and the corresponding transfer rollers 41, toner images of corresponding colors formed on the respective image bearing members 1 are transferred onto the paper P in order such that the toner images are superimposed on one another. Thereafter, the image bearing members 1 continue to rotate and a next process is performed. Through the above, description has been provided with reference to FIG. 3 for the image forming apparatus according to the alternative form of the third embodiment in which the direct transfer process is adopted.

As described with reference to FIGS. 2 and 3, the image forming apparatus 6 according to the third embodiment includes the photosensitive members 1 according to the first embodiment as image bearing members. The photosensitive members 1 have excellent sensitivity and can reduce occurrence of black spots in a high temperature and humidity environment. Including such photosensitive members 1 as image bearing members, the image forming apparatus 6 according to the third embodiment can form images while reducing occurrence of black spots in a high temperature and humidity environment with the photosensitive members 1 having excellent sensitivity.

Fourth Embodiment: Process Cartridge

The fourth embodiment of the present disclosure relates to a process cartridge. The process cartridge according to the fourth embodiment for example has a unitized configuration including the photosensitive member 1 of the first embodiment. The process cartridge may be designed to be freely attachable to and detachable from the image forming apparatus 6 according to the third embodiment. The process cartridge for example adopts a unitized configuration including, in addition to the photosensitive member 1, one or more selected from the group consisting of the elements described for the third embodiment (more specifically, the charging section 27, the light exposure section 28, the development section 29, the transfer section 26, the cleaning section, and the static eliminator).

Through the above, the process cartridge according to the fourth embodiment has been described. The process cartridge according to the fourth embodiment includes the photosensitive member 1 according to the first embodiment. The photosensitive member 1 according to the first embodiment has excellent sensitivity and can reduce occurrence of black spots in a high temperature and humidity environment. The process cartridge according to the fourth embodiment therefore provides excellent sensitivity and can form images while reducing occurrence of black spots in a high temperature and humidity environment. Furthermore, a process cartridge such as described above is easy to handle and can therefore be easily and quickly replaced, together with the image bearing member 1, when sensitivity characteristics or the like of the image bearing member 1 deteriorate.

Examples

The following provides more specific description of the present disclosure through use of Examples. However, the present disclosure is not in any sense limited by the scope of the Examples.

[1. Photosensitive Member Materials]

A charge generating material, hole transport materials, electron transport materials, and a binder resin described below were prepared as materials for forming photosensitive layers of photosensitive members.

A compound (CGM-1X) was prepared as the charge generating material. The compound (CGM-1X) was metal-free phthalocyanine represented by the chemical formula (CGM-1) mentioned for the first embodiment. Furthermore, the compound (CGM-1X) had an X-form crystalline structure.

The compounds (HTM-1) to (HTM-6) were prepared as the hole transport materials. The compounds (HTM-1) to (HTM-6) have been described for the first embodiment.

The compounds (ETM-1) to (ETM-3) were prepared as the electron transport materials. The compounds (ETM-1) to (ETM-3) have been described in the first embodiment.

(ETM-4)

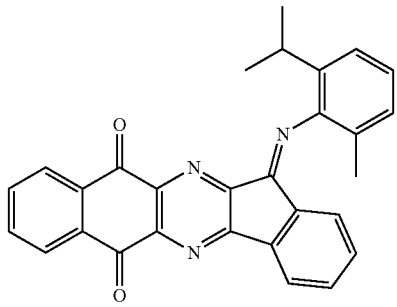

-continued (ETM-5)

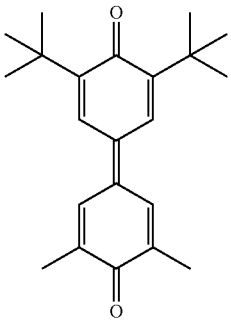

(ETM-6)

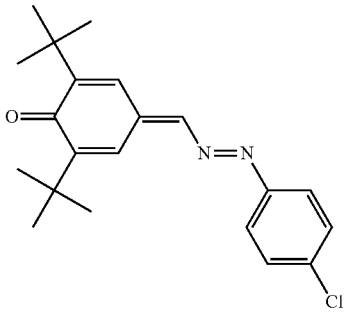

(ETM-7)

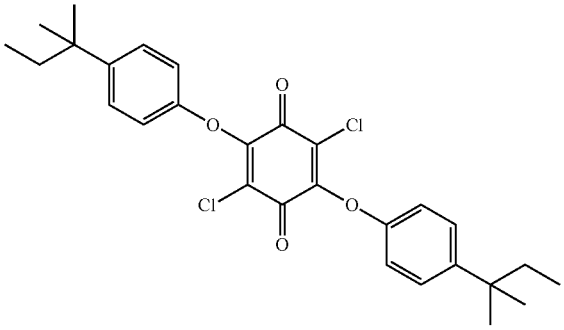

A polycarbonate resin (Za) was prepared as the binder resin. The polycarbonate resin (Za) was the polycarbonate resin represented by the chemical formula (Z) described for the first embodiment. Furthermore, the viscosity average molecular weight of the polycarbonate resin (Za) was 40,000.

[2. Photosensitive Member Production]

Photosensitive members (A-1) to (A-16) and photosensitive members (B-1) to (B-4) and (B-6) to (B-13) were produced using the thus prepared materials for forming the photosensitive layers of the photosensitive members.

(2-1. Production of Photosensitive Member (A-1))

First, a conductive substrate was prepared. The conductive substrate was an aluminum conductive substrate having a diameter of 160 mm, a length of 365 mm, and a thickness of 2 mm. The conductive substrate was immersed in ionized alkaline water for 60 seconds, and subsequently an oxide film formation step was performed. The conductive substrate was immersed in water, taken out of the water, and heated to form an aluminum oxide film on a surface of the conductive substrate. The volume resistivity of the water was $2.5\times10^6$ Ω·cm. The temperature of the water was 80° C. The conductive substrate was immersed in the water for 30 seconds. The heating was performed using an oven at a heating temperature of 120° C. for 10 minutes at ambient atmosphere.

Next, a photosensitive layer formation step was performed. First, an application liquid was prepared. More specifically, 5 parts by mass of the compound (CGM-1X) as the charge generating material, 60 parts by mass of the compound (HTM-3) as the hole transport material, 35 parts by mass of the compound (ETM-1) as the electron transport material, 90 parts by mass of the polycarbonate resin (Za) as the binder resin, and 800 parts by mass of tetrahydrofuran as a solvent were added into a vessel. The vessel contents were mixed for 50 hours using a ball mill so that the materials were dispersed to give an application liquid.

Next, the application liquid was applied by dip coating onto the conductive substrate obtained through the oxide film formation step to form a film of the application liquid on the conductive substrate. More specifically, the conductive substrate was immersed in the application liquid. Next, the conductive substrate was drawn out of the application liquid. Through the above, the application liquid was applied onto the conductive substrate.

Next, the conductive substrate having a film of the application liquid was dried by hot air at 100° C. for 40 minutes. Thus, the solvent (tetrahydrofuran) was removed from the application liquid. As a result, a photosensitive layer was formed on the conductive substrate. Through the above, the photosensitive member (A-1) was obtained.

(2-2. Production of Photosensitive Members (A-2) to (A-18) and members (B-1) to (B-4) and (B-6) to (B-13))

The photosensitive members (A-2) to (A-18) and members (B-1) to (B-4) and (B-6) to (B-13) were produced in the same manner as in the production of the photosensitive member (A-1) except the following changes.

Conditions for formation of the oxide film of the conductive substrate in the production of the photosensitive member (A-1) were changed. More specifically, the water temperature of 70° C., the water immersion time of 60 seconds, and the heating temperature 120° C. were changed to each water temperature, each water immersion time, and each heating temperature shown in Tables 1 and 2.

The compound (ETM-1) as the electron transport material and the compound (HTM-1) as the hole transport material that were used for preparation of the application liquid in the production of the photosensitive member (A-1) were changed to each electron transport material and each hole transport material shown in Tables 1 and 2.

[3. Measurement Methods]

(3-1. Measurement of Reduction Potential of Electron Transport Material)

The reduction potential of each electron transport material was determined by performing cyclic voltammetry under the following conditions.

Working electrode: glassy carbon

Counter electrode: platinum

Reference electrode: silver/silver nitrate (0.1 mol/L, a solution of $AgNO_3$ in acetonitrile)

Sample solution electrolyte: tetra-n-butylammonium perchlorate (0.1 mol)

Measurement target: electron transport material (0.001 mol)

Solvent: dichloromethane (1 L)

(3-2. Measurement of Leakage Onset Voltage of Photosensitive Member)

The leakage onset voltage of each photosensitive member was measured using a pressure-resistant tester (testing instrument fabricated by KYOCERA Document Solutions Inc.) under the following conditions.

Temperature: 30° C.

Relative humidity: 80%

(3-3. Proportion R of Oxygen Atoms Present in Surface of Conductive Substrate)

First, the surface of each conductive substrate was measured by energy dispersive X-ray spectroscopy (EDX) using an energy dispersive X-ray spectrometer ("JSM-6380LV", product of JEOL Ltd.). Measurement conditions were an accelerating voltage of 5 keV, an X-ray irradiation area of 400 $\mu m^3$, and a measurement depth of 10 nm. Thus, the oxygen atom concentration ($A_O$, unit: atomic %) and the aluminum atom concentration ($A_{Al}$, unit: atomic %) in the surface of the conductive substrate were measured. Based on the oxygen atom concentration and the aluminum atom concentration that were measured, the proportion R of oxygen atoms present in the surface of the conductive substrate was calculated in accordance with equation (1) shown below. Tables 1 and 2 show the thus calculated proportion R of oxygen atoms.

$$R=[A_O/(A_O+A_{Al})]\times 100 \quad \text{Equation (1)}$$

(3-4. Measurement of Oxide Film Thickness)

The oxide film thickness was measured using a reflective/transmissive thin film thickness measuring device ("NANO-CALC-VIS", product of Tokyo Instruments, Inc.). Tables 1 and 2 show the thus measured oxide film thickness.

[4. Evaluation Methods]

(4-1. Image Evaluation (Black Spots))

A printer (dry-type electrophotographic printer including a semiconductor laser, "FS-1300D", product of KYOCERA Document Solutions Inc.) was used as an evaluation apparatus. The evaluation apparatus included a charging roller as a charging section. The charging section had a positive charging polarity. The evaluation apparatus included a direct-transfer type transfer section (transfer roller). The evaluation apparatus included a development section having a photosensitive member cleaning function. "KYOCERA Document Solutions-brand paper VM-A4 (A4 size)", product of KYOCERA Document Solutions Inc. was used as paper for evaluations. "Non-magnetic one-component toner", product of KYOCERA Document Solutions Inc. was used as a toner for the evaluations. Measurements for the evaluations were carried out in a high temperature and humidity environment (temperature: 32.5° C., relative humidity: 80%). With respect to each of the photosensitive members, the photosensitive member was mounted in the evaluation apparatus. An image was formed under a condition of a linear velocity of 168 mm/second. In order to stabilize the operation of the photosensitive member in the evaluation apparatus, an alphabetical image was printed on 1,000 sheets of the paper. Subsequently, an image D was printed on a sheet and used as an evaluation sample for black spot evaluation. The image D was an entirely white image. The thus obtained evaluation sample was visually observed to determine presence of black spots. Based on the observation result, image evaluation was performed in terms of black spots as an image defect in accordance with the following evaluation standard.

(Evaluation Standard of Image Evaluation in terms of Black Spots)

G (Good): five or less black spots

P (Poor): more than 5 black spots (4-2. Measurement of Sensitivity Potential of Photosensitive Member)

The sensitivity potential of each photosensitive member was measured using a drum sensitivity test device (Gentec Inc.) under environmental conditions of a temperature of 10° C. and a relative humidity of 20%. The surface of the photosensitive member was charged to a surface potential of +600 V. Thereafter, the surface of the photosensitive member was exposed to monochromatic light (light exposure wavelength: 780 nm) at a light exposure amount of 0.26 $\mu J/cm^2$. A surface potential ($V_L$) of an exposed region of the photosensitive member was measured 50 milliseconds after exposure to the light. Sensitivity of the photosensitive member was evaluated in accordance with the following standard.

G (Good): a surface potential ($V_L$) of no greater than +130 V

P (Poor): a surface potential ($V_L$) of greater than +130 V

TABLE 1

| Example | Photo-sensitive member No. | Conductive substrate: Oxide filmformation step: Water temp. (° C.) | Immersion time (seconds) | Heating temp. (° C.) | Proportion of oxygen atoms (%) | Oxide filmthickness (μm) | Photo-sensitive layer Electron transport material: Type | Reduction potential (V) | Photo-sensitive member Leakage onset voltage (kV) |
|---|---|---|---|---|---|---|---|---|---|
| Example 1 | A-1 | 70 | 60 | 120 | 22 | 0.16 | ETM-1 | −0.88 | 5.00 |
| Example 2 | A-2 | 70 | 90 | 120 | 26 | 0.20 | ETM-1 | −0.88 | 5.10 |
| Example 3 | A-3 | 80 | 15 | 120 | 21 | 0.16 | ETM-1 | −0.88 | 5.20 |
| Example 4 | A-4 | 80 | 30 | 120 | 26 | 0.20 | ETM-1 | −0.88 | 5.20 |
| Example 5 | A-5 | 80 | 60 | 120 | 30 | 0.24 | ETM-1 | −0.88 | 5.50 |
| Example 6 | A-6 | 80 | 90 | 120 | 38 | 0.30 | ETM-1 | −0.88 | 5.60 |
| Example 7 | A-7 | 80 | 15 | 110 | 21 | 0.16 | ETM-1 | −0.88 | 5.20 |
| Example 8 | A-8 | 80 | 15 | 120 | 21 | 0.16 | ETM-1 | −0.88 | 5.10 |
| Example 9 | A-9 | 80 | 15 | 150 | 21 | 0.16 | ETM-1 | −0.88 | 5.20 |
| Example 10 | A-10 | 95 | 5 | 120 | 20 | 0.15 | ETM-1 | −0.88 | 5.10 |
| Example 11 | A-11 | 95 | 15 | 120 | 28 | 0.21 | ETM-1 | −0.88 | 5.30 |
| Example 12 | A-12 | 95 | 30 | 120 | 34 | 0.28 | ETM-1 | −0.88 | 5.50 |
| Example 13 | A-13 | 95 | 60 | 120 | 40 | 0.32 | ETM-1 | −0.88 | 5.60 |
| Example 14 | A-14 | 95 | 90 | 120 | 46 | 0.35 | ETM-1 | −0.88 | 5.80 |
| Example 15 | A-15 | 80 | 15 | 120 | 21 | 0.16 | ETM-2 | −0.70 | 5.40 |
| Example 16 | A-16 | 80 | 15 | 120 | 21 | 0.16 | ETM-3 | −0.66 | 5.60 |
| Example 17 | A-17 | 95 | 90 | 120 | 34 | 0.28 | ETM-2 | −0.70 | 5.80 |
| Example 18 | A-18 | 95 | 90 | 120 | 34 | 0.28 | ETM-3 | −0.66 | 6.20 |

TABLE 2

| Comparative Example | Photo-sensitive member No. | Conductive substrate: Oxide filmformation step: Water temp. (° C.) | Immersion time (seconds) | Heating temp. (° C.) | Proportion of oxygen atoms (%) | Oxide filmthickness (μm) | Photo-sensitive layer Electron transport material: Type | Reduction potential (V) | Photo-sensitive member Leakage onset voltage (kV) |
|---|---|---|---|---|---|---|---|---|---|
| Comparative Example 1 | B-1 | — | — | — | 1 | 0 | ETM-1 | −0.88 | 4.50 |
| Comparative Example 2 | B-2 | 70 | 5 | 120 | 3 | 0 | ETM-1 | −0.88 | 4.70 |
| Comparative Example 3 | B-3 | 70 | 15 | 120 | 5 | 0 | ETM-1 | −0.88 | 4.80 |
| Comparative Example 4 | B-4 | 70 | 30 | 120 | 8 | 0.06 | ETM-1 | −0.88 | 4.80 |
| Comparative Example 6 | B-6 | 80 | 15 | 120 | 21 | 0.15 | ETM-4 | −0.96 | 4.00 |
| Comparative Example 7 | B-7 | 80 | 15 | 120 | 21 | 0.15 | ETM-5 | −0.93 | 4.40 |
| Comparative Example 8 | B-8 | 80 | 15 | 120 | 21 | 0.15 | ETM-6 | −0.93 | 4.50 |
| Comparative Example 9 | B-9 | 80 | 15 | 120 | 21 | 0.15 | ETM-7 | −0.55 | 6.00 |
| Comparative Example 10 | B-10 | 95 | 90 | 120 | 46 | 0.35 | ETM-4 | −0.96 | 4.50 |
| Comparative Example 11 | B-11 | 95 | 90 | 120 | 46 | 0.35 | ETM-5 | −0.93 | 4.80 |
| Comparative Example 12 | B-12 | 95 | 90 | 120 | 46 | 0.35 | ETM-6 | −0.93 | 4.80 |
| Comparative Example 13 | B-13 | 95 | 90 | 120 | 46 | 0.35 | ETM-7 | −0.55 | 6.40 |
| Comparative Example 14 | B-14 | 80 | 60 | 120 | 30 | 0.24 | — | — | 4.50 |

As shown in Table 1, the photosensitive layer of each of the photosensitive members (A-1) to (A-18) included any of the electron transport materials (ETM-1) to (ETM-3). The reduction potential of the electron transport materials (ETM-1) to (ETM-3) was within a range of from −0.88 V to −0.66 V versus the reference electrode ($Ag/Ag^+$). The leak onset voltage of the photosensitive members (A-1) to (A-18) in the high temperature and humidity environment was within a range of from 5.00 kV to 6.20 kV. The photosensitive members (A-1) to (A-18) each had an aluminum oxide film.

As shown in Table 2, the leakage onset voltage of the photosensitive members (B-1) to (B-4) was within a range of from 4.50 kV to 4.90 kV. The photosensitive layer of each of the photosensitive members (B-6) to (B-13) contained any of the electron transport materials (ETM-4) to (ETM-7). The reduction potential of the electron transport materials (ETM-4) to (ETM-7) was within a range of from −0.96 V to −0.93 V or was −0.55 V versus the reference electrode ($Ag/Ag^+$). The leakage onset voltage of the photosensitive members (B-6) to (B-8) and the photosensitive members (B-10) to (B-12) was within a range of from 4.00 kV to 4.80 kV.

TABLE 3

| | Photo-sensitive member No. | Image defect: Black spot count | Evaluation | Electrical properties (sensitivity): Sensitivity potential (V) | Evaluation |
|---|---|---|---|---|---|
| Example 1 | A-1 | 4 | G | +119 | G |
| Example 2 | A-2 | 3 | G | +119 | G |
| Example 3 | A-3 | 3 | G | +117 | G |
| Example 4 | A-4 | 3 | G | +118 | G |
| Example 5 | A-5 | 3 | G | +121 | G |

TABLE 3-continued

| | Photo-sensitive member No. | Image defect: Black spot count | Evaluation | Electrical properties (sensitivity): Sensitivity potential (V) | Evaluation |
|---|---|---|---|---|---|
| Example 6 | A-6 | 2 | G | +122 | G |
| Example 7 | A-7 | 4 | G | +118 | G |
| Example 8 | A-8 | 5 | G | +119 | G |
| Example 9 | A-9 | 4 | G | +117 | G |
| Example 10 | A-10 | 3 | G | +122 | G |
| Example 11 | A-11 | 4 | G | +119 | G |
| Example 12 | A-12 | 3 | G | +123 | G |
| Example 13 | A-13 | 2 | G | +117 | G |
| Example 14 | A-14 | 1 | G | +120 | G |
| Example 15 | A-15 | 3 | G | +118 | G |
| Example 16 | A-16 | 2 | G | +119 | G |
| Example 17 | A-17 | 2 | G | +117 | G |
| Example 18 | A-18 | 1 | G | +118 | G |

TABLE 4

| | Photo-sensitive member No. | Image defect: Black spot count | Evaluation | Electrical properties (sensitivity): Sensitivity potential (V) | Evaluation |
|---|---|---|---|---|---|
| Comparative Example 1 | B-1 | 22 | P | +119 | G |
| Comparative Example 2 | B-2 | 15 | P | +117 | G |
| Comparative Example 3 | B-3 | 10 | P | +120 | G |
| Comparative Example 4 | B-4 | 9 | P | +118 | G |

TABLE 4-continued

| | Photo-sensitive member No. | Image defect | | Electrical properties (sensitivity) | |
|---|---|---|---|---|---|
| | | Black spot count | Evaluation | Sensitivity potential (V) | Evaluation |
| Comparative Example 6 | B-6 | 31 | P | +118 | G |
| Comparative Example 7 | B-7 | 25 | P | +119 | G |
| Comparative Example 8 | B-8 | 24 | P | +117 | G |
| Comparative Example 9 | B-9 | 1 | G | +178 | P |
| Comparative Example 10 | B-10 | 24 | P | +122 | G |
| Comparative Example 11 | B-11 | 19 | P | +117 | G |
| Comparative Example 12 | B-12 | 18 | P | +119 | G |
| Comparative Example 13 | B-13 | 1 | G | +178 | P |

As shown in Table 3, both the result of the image evaluation and the result of the sensitivity evaluation of each of the photosensitive members (A-1) to (A-18) were G (Good). As shown in Table 4, the result of the image evaluation or the result of the sensitivity evaluation of each of the photosensitive members (B-1) to (B-4) and (B-6) to (B-13) was P (Poor). More specifically, the result of the image evaluation of each of the photosensitive members (B-1) to (B-4) and (B-6) to (B-8) and the photosensitive members (B-10) to (B-12) was P (Poor). The result of the sensitivity evaluation of each of the photosensitive member (B-9) and the photosensitive member (B-13) was P (Poor).

The evaluation results indicate that the photosensitive members (A-1) to (A-18) are superior to the photosensitive members (B-1) to (B-4) and (B-6) to (B-13) in sensitivity and capability of reducing occurrence of black spots in a high temperature and humidity environment.

What is claimed is:

1. A single-layer electrophotographic photosensitive member comprising a conductive substrate and a photosensitive layer disposed directly on the conductive substrate, wherein the conductive substrate contains aluminum or an aluminum alloy, a surface of the conductive substrate has a film of an oxide of the aluminum or a film of an oxide of the aluminum alloy, the film of the oxide of the aluminum or the film of the oxide of the aluminum alloy has a thickness of at least 0.15 μm and no greater than 0.35 μm, the photosensitive layer contains a charge generating material and an electron transport material, the charge generating material is X-form metal-free phthalocyanine, the electron transport material has a reduction potential of at least −0.88 V and no greater than −0.66 V versus a reference electrode ($Ag/Ag^+$), the single-layer electrophotographic photosensitive member has a leakage onset voltage of at least 5.0 kV in a high temperature and humidity environment at a temperature of 30° C. and a relative humidity of 80%, the leakage onset voltage being a voltage applied to the single-layer electrophotographic photosensitive member at which current leakage starts, the electron transport material includes a compound represented by general formula (2) or general formula (3) shown below, (2)

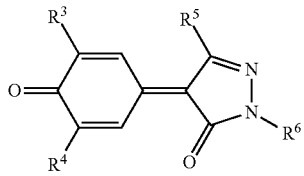

(3)

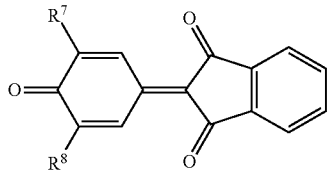

where in the general formulae (2) and (3), $R^3$, $R^4$, $R^5$, $R^6$, $R^7$, and $R^8$ each represent, independently of one another, an alkyl group that may have a substituent selected from the group consisting of alkoxy groups and halogen atoms or an aryl group that may have a substituent selected from the group consisting of alkoxy groups and halogen atoms, and a proportion R of oxygen atoms present in the film of an oxide of the aluminum or the film of an oxide of the aluminum alloy is at least 20% and no greater than 50%, the proportion R being calculated in accordance with equation (1) shown below, $$R=[A_O/(A_O+A_{Al})]\times 100 \quad \text{Equation (1)}$$

where in the equation (1), $A_O$ represents an oxygen atom concentration determined by measuring the film of an oxide of the aluminum or the film of an oxide of the aluminum alloy by energy dispersive X-ray spectroscopy, and $A_{Al}$ represents an aluminum atom concentration determined by measuring the film of an oxide of the aluminum or the film of an oxide of the aluminum alloy by energy dispersive X-ray spectroscopy.

2. The single-layer electrophotographic photosensitive member according to claim 1, wherein in the general formulae (2) and (3), $R^3$, $R^4$, $R^5$, $R^7$, and $R^8$ each represent, independently of one another, an alkyl group having a carbon number of at least 1 and no greater than 5, and $R^6$ represents a phenyl group having a halogen atom.

3. The single-layer electrophotographic photosensitive member according to claim 1, wherein the electron transport material includes a compound represented by chemical formula (ETM-2) or chemical formula (ETM-3) shown below (ETM-2)

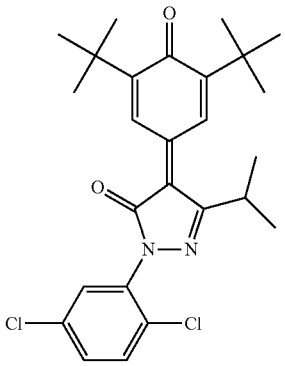

(ETM-3)

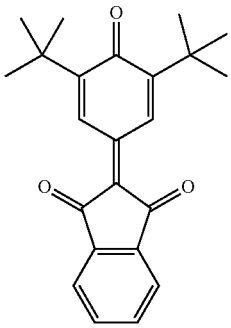

4. A process cartridge comprising the single-layer electrophotographic photosensitive member according to claim 1.

5. An image forming apparatus comprising:

an image bearing member; and a charger configured to charge a surface of the image bearing member, wherein the charger has a positive charging polarity, and the image bearing member is the single-layer electrophotographic photosensitive member according to claim 1.

6. The image forming apparatus according to claim 5, further comprising a development section configured to develop an electrostatic latent image into a toner image while in contact with the image bearing member.

7. The image forming apparatus according to claim 6, wherein the development section cleans the surface of the image bearing member.

8. The image forming apparatus according to claim 5, wherein the charger is a charging roller.

* * * * *